US010160529B2

(12) United States Patent
Karila et al.

(10) Patent No.: US 10,160,529 B2
(45) Date of Patent: Dec. 25, 2018

(54) SLEWING SEAL ARRANGEMENT FOR A PROPULSION UNIT

(71) Applicant: ABB Oy, Helsinki (FI)

(72) Inventors: Kai Karila, Vantaa (FI); Jussi Kiiskilä, Helsinki (FI); Ville Kortelainen, Helsinki (FI); Erkki Ronkainen, Vantaa (FI); Tero Tamminen, Espoo (FI)

(73) Assignee: ABB Oy, Helsinki (FI)

( * ) Notice: Subject to any disclaimer, the term of this patent is extended or adjusted under 35 U.S.C. 154(b) by 227 days.

(21) Appl. No.: 15/310,774

(22) PCT Filed: May 12, 2015

(86) PCT No.: PCT/FI2015/050320
§ 371 (c)(1),
(2) Date: Nov. 13, 2016

(87) PCT Pub. No.: WO2015/173471
PCT Pub. Date: Nov. 19, 2015

(65) Prior Publication Data

US 2017/0081006 A1 Mar. 23, 2017

(30) Foreign Application Priority Data

May 13, 2014 (EP) ..... 14168086

(51) Int. Cl.
*B63H 5/125* (2006.01)

(52) U.S. Cl.
CPC ..... *B63H 5/125* (2013.01); *B63H 2005/1258* (2013.01)

(58) Field of Classification Search
CPC . B63H 5/125; B63H 20/00; B63H 2005/1258
See application file for complete search history.

(56) References Cited

U.S. PATENT DOCUMENTS 3,773,336 A * 11/1973 Walter ..... B63H 23/36 277/551
3,896,757 A * 7/1975 Kucher ..... B63H 5/125 440/58

(Continued)

FOREIGN PATENT DOCUMENTS

EP 0888962 A2 1/1999
FI 110252 B 12/2002

(Continued)

OTHER PUBLICATIONS

International Search Report, PCT/FI2015/050320, dated Aug. 4, 2015, ABB Oy, 4 pages.

(Continued)

*Primary Examiner* — Lars A Olson
*Assistant Examiner* — Jovon E Hayes
(74) *Attorney, Agent, or Firm* — J. Bruce Schelkopf; Taft Stettinius & Hollister LLP

(57) ABSTRACT

The propulsion unit comprises a strut having an upper portion with an upper end portion passing through a passage formed between a first outer bottom and a second inner bottom in a vessel. The upper end portion is rotatable supported with a slewing bearing and sealed with a slewing seal. An upper slewing seal prevents lubrication medium leakage from the slewing bearing, whereby access to the upper slewing seal is provided in a radial direction from the interior of the vessel or from the interior of the strut in order to be able to service the upper slewing seal. A lower slewing seal is positioned at a vertical distance below the upper slewing seal and prevents sea water from penetrating into the hull of the vessel, whereby access to the lower slewing seal is provided in a radial direction from the interior of the vessel or from the interior of the strut in order to be able to service the lower slewing seal.

20 Claims, 9 Drawing Sheets

(56) References Cited

U.S. PATENT DOCUMENTS

| | | | | |
|---|---|---|---|---|
| 5,820,132 | A * | 10/1998 | Marnot | F16J 15/008 277/551 |
| 7,523,943 | B2 * | 4/2009 | Beichl | F16J 15/3288 277/355 |
| 8,267,732 | B1 * | 9/2012 | Poirier | B63H 21/38 440/76 |
| 2010/0014791 | A1 * | 1/2010 | Versteegh | F16C 19/184 384/147 |
| 2015/0329191 | A1 * | 11/2015 | Kiiskila | H02K 9/10 417/423.8 |
| 2016/0059950 | A1 * | 3/2016 | Kortelainen | F16J 15/46 277/562 |
| 2017/0081006 | A1 * | 3/2017 | Karila | B63H 5/125 |
| 2018/0072395 | A1 * | 3/2018 | Pellinen | B63H 5/125 |

FOREIGN PATENT DOCUMENTS

| | | | |
|---|---|---|---|
| JP | 1170891 | A | 3/1999 |
| JP | 2005170318 | A | 6/2005 |
| JP | 2008001208 | A | 1/2008 |
| WO | 2013098469 | A1 | 7/2013 |
| WO | 2014202823 | A1 | 12/2014 |

OTHER PUBLICATIONS

European Search Report and Written Opinion, EP14168086, dated Dec. 5, 2014, 5 pages.

Office Action for Japanese Application No. 2016-567508, dated Sep. 6, 2017, 3 pages. (English Translation Included).

* cited by examiner

SLEWING SEAL ARRANGEMENT FOR A PROPULSION UNIT

FIELD OF THE INVENTION

The present invention relates to a slewing seal arrangement for a propulsion unit according to the preamble of claim 1.

BACKGROUND ART

A propulsion unit comprises a strut having an upper portion and a lower portion. An upper end portion of the upper portion passes through a passage formed between a first outer bottom and a second inner bottom of a vessel. The upper end portion is rotatable supported at the hull of the vessel with a slewing bearing and sealed against the hull of the vessel with a slewing seal. The slewing seal prevents lubrication medium leakage from the slewing bearing to the sea. The slewing seal prevents further water from penetrating into the vessel.

The slewing bearing is in one prior art solution positioned below the second inner bottom of the vessel in the space between the first outer bottom and the second inner bottom of the vessel. The slewing seal is positioned immediately below the slewing bearing. The slewing bearing comprises an upper slewing seal preventing lubrication medium leakage from the slewing bearing to the sea and a lower slewing seal preventing sea water from penetrating into the vessel and into the slewing bearing. The upper slewing seal and the lower slewing seal are formed as one entity in a common recess. The slewing seal is positioned so that it is only accessible from above. This means that the slewing bearing and the gearwheel positioned on the slewing bearing has to be disconnected and removed before access to the slewing seal is provided.

It is thus rather difficult and time consuming to service and change the slewing seal in such prior art slewing seal arrangements. The condition of the slewing seal has been monitored indirectly by monitoring the condition of the lubrication medium. Water in the lubrication medium indicates that the slewing seal is leaking. Visual inspection of the slewing seal without dismantling the slewing bearing and the gearwheel is only possible e.g. through bores penetrating into the area of the slewing seal. This means that it is rather difficult to monitor the condition of the slewing seal. The lifetime of the slewing seal is normally shorter than the lifetime of the slewing bearing. The slewing seal should thus be changed more often than the slewing bearing. There is thus a risk that the slewing seal will not be changed as often as would be optimal.

BRIEF DESCRIPTION OF THE INVENTION

An object of the present invention is to achieve an improved slewing seal arrangement for a propulsion unit.

The slewing seal arrangement for a propulsion unit according to the invention is characterized by what is stated in the characterizing portion of claim 1.

The slewing seal arrangement for a propulsion unit comprises a hollow strut having an upper portion and a lower portion, an upper end portion of the upper portion passing through a passage formed between a first outer bottom and a second inner bottom in a vessel, said upper end portion being rotatable, around an axis of rotation, supported at a hull of the vessel with a slewing bearing and sealed against the hull of the vessel with a slewing seal comprising an upper slewing seal and a lower slewing seal.

The slewing seal arrangement is characterized in that:

the upper slewing seal is positioned below the slewing bearing in order to prevent lubrication medium leakage from the slewing bearing, whereby access to the upper slewing seal is provided in a radial direction from the interior of the vessel or from the interior of the strut in order to be able to service the upper slewing seal, the lower slewing seal is positioned at a vertical distance below the upper slewing seal in order to prevent sea water from penetrating via the passage into the hull of the vessel, whereby access to the lower slewing seal is provided in a radial direction from the interior of the vessel or from the interior of the strut in order to be able to service the lower slewing seal.

The benefit of the invention is easy access to the slewing seal in order to be able to service the slewing seal from the interior of the vessel or from the interior of the strut. Easy access to the slewing seal enables also easy and more reliable inspection of the slewing seal.

The upper slewing seal and the lower slewing seal are in one embodiment positioned above the second inner bottom of the vessel. The slewing seals can thus be serviced from the interior of the vessel from the space above the second inner bottom of the vessel.

The upper slewing seal and the lower slewing seal are in another embodiment positioned below the second inner bottom of the vessel in the space between the first outer bottom and the second inner bottom of the vessel. The slewing seals can thus be serviced from the interior of the vessel from the space between the first outer bottom and the second inner bottom of the vessel.

The upper slewing seal is in another embodiment positioned below the second inner bottom of the vessel in the space between the first outer bottom and the second inner bottom of the vessel and the lower slewing seal is positioned in the strut. The upper slewing seal can thus be serviced from the interior of the vessel from the space between the first outer bottom and the second inner bottom of the vessel. The lower slewing seal can be serviced from the interior of the strut.

Radial access to the upper slewing seal and the lower slewing seal can thus be provided from the interior of the vessel or from the interior of the strut.

There is thus no need to dismantle the slewing bearing and the gearwheel in order to service the slewing seal.

Easy access and easy change of the slewing seal means reduced service costs and better sealing reliability.

It is possible to arrange an automatic monitoring system and/or a lubrication medium collection system in connection with the upper slewing seal in order to detect lubrication medium leakage from the slewing bearing positioned above the upper slewing seal. The lubrication medium collection system can be used to direct a lubrication medium leakage to a space within the vessel either above the second inner bottom of the vessel or to the space between the first outer bottom and the second inner bottom of the vessel. Leakage of lubrication medium to the sea can thus be avoided.

Water leakage from the lower slewing seal into the vessel will not penetrate into the slewing bearing. It is also easy to detect water leakage in the arrangement.

The slewing bearing is in one embodiment positioned at or above the second inner bottom of the vessel. The benefit of such an arrangement is that the whole slewing bearing will be surrounded by the same internal air in the interior of the vessel. The uniform temperature distribution will considerably reduce thermal tensions in the slewing bearing compared to a prior art solution where different parts of the slewing bearing are subjected to different temperatures. A part of the slewing bearing is subjected to warm internal air and another part of the slewing bearing is subjected cold air propagating along the steel structures from the sea.

The change of the slewing seal can be done without docking the vessel. In the case the water level is above the sealing and the ship cannot be trimmed, a diver can place a temporary seal in the passage between the upper portion of the strut and the outer bottom of the vessel. A fixed seal can also be used, which is activated e.g. by pressurizing.

The slewing seal arrangement can be made simple in the invention as there is no need to try to prolong the lifetime of the slewing seal.

The slewing bearing and the slewing seal is in one embodiment positioned at or above the second inner bottom of the vessel. This seems, according to the present knowledge, to be an advantageous solution in the sense that no access to the space between the first outer bottom and the second inner bottom in the vessel is needed. The slewing seal can be changed from the space within the hull of the vessel above the second inner bottom.

The hull of the vessel means in this application the watertight outer body of the vessel.

BRIEF DESCRIPTION OF THE DRAWINGS

In the following the invention will be described in greater detail by means of preferred embodiments with reference to the attached drawings, in which.

DETAILED DESCRIPTION OF THE INVENTION

Figure 1:
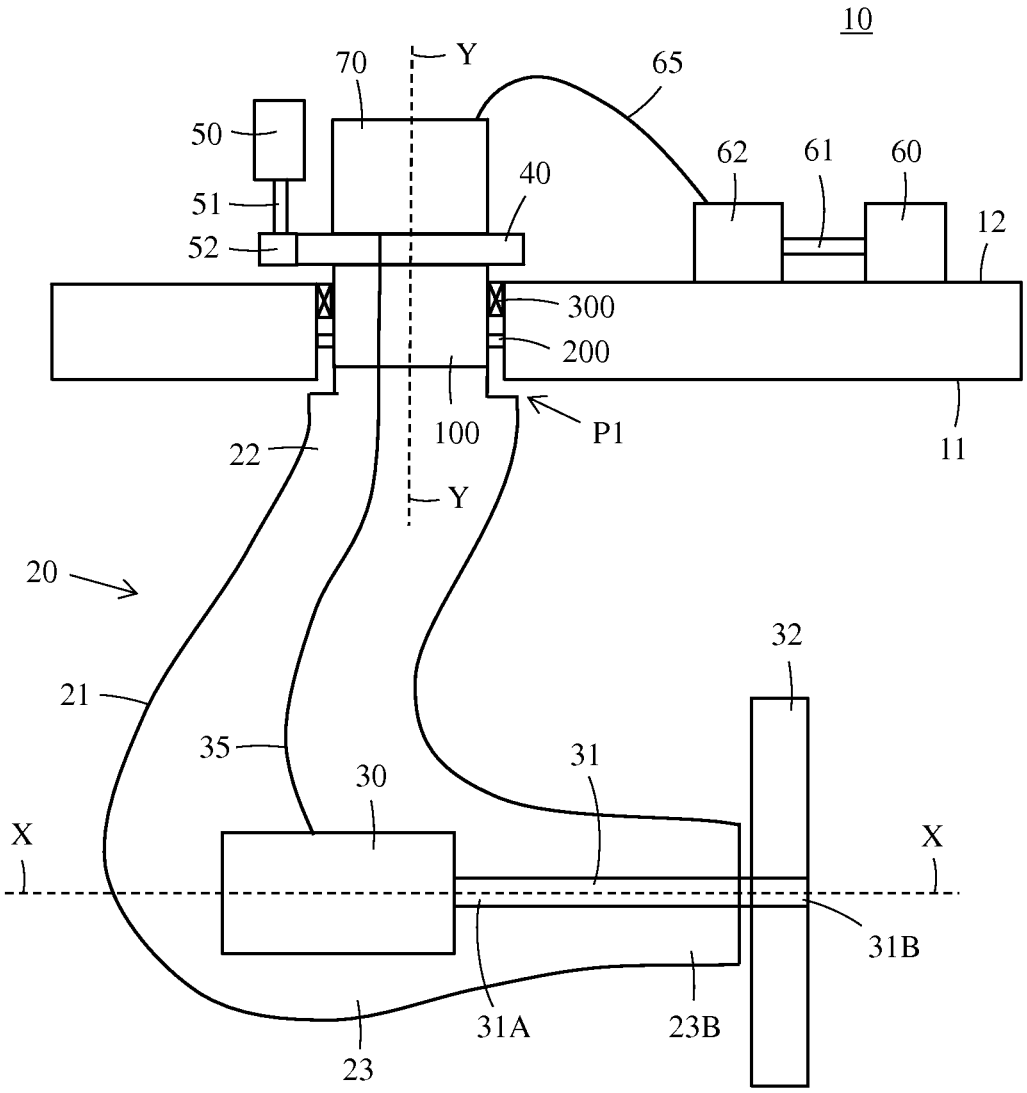
FIG. 1 shows a vertical cross section of a propulsion unit in a vessel.

FIG. 1 shows a vertical cross section of a propulsion unit in a vessel. The vessel 10 has a double bottom i.e. a first outer bottom 11 forming the hull of the vessel and a second inner bottom 12. The propulsion 20 unit comprises a hollow strut 21 with an upper portion 22 and a lower portion 23. The upper portion 22 of the strut 21 forms a support arm supporting the lower portion 23 of the strut. The lower portion 23 of the strut 21 forms a longitudinal compartment comprising a first electric motor 30 and a first shaft 31. A first end 31A of the first shaft 31 is connected to the electric motor 30 and a second end 31B of the first shaft 31 protrudes from an aft end 23B of the lower portion 23 of the strut 21. A propeller 32 is connected to the second outer end 31B of the first shaft 31. The axial centre line X-X of the first shaft 31 forms a shaft line. The propulsion unit 20 is rotatably attached to the vessel 10 via the upper portion 22 of the strut 21 so that it can turn 360 degrees around a centre axis Y-Y of rotation. A passage P1 is formed in the bottom of the vessel 10 from the first outer bottom 11 to the second inner bottom 12 of the vessel 10. The upper portion 22 of the strut 21 of the propulsion unit 20 is connected to an upper block 100. The upper block 100 passes through the passage P1 and is rotatably attached with a slewing bearing 300 to the hull of the vessel 10. The upper block 100 has normally a generally cylindrical from. The upper block 100 could instead of being a separate part be formed by an upper end portion of the upper portion 22 of the strut 21. A slewing seal 200 positioned under the slewing bearing 300 forms the seal between sea water and the interior of the hull of the vessel 10.

A gearwheel 40 is further attached to the upper block 100. The gearwheel 40 can be turned 360 degrees around the centre axis Y-Y of rotation with a second electric motor 50. The second electric motor 50 drives a pinion wheel 52 through a second shaft 51. The cogs of the pinion wheel 52 are connected to the cogs of the gearwheel 40. There can naturally be several similar second electric motors 50 connected to the gearwheel 40. The turning of the gearwheel 40 will turn the propulsion unit 20. The gearwheel 40 has a ring form with a hole in the middle. The cogs of the gearwheel 40 are in this embodiment positioned on the outer edge of the gearwheel 40. The other possibility is to have the cogs on the inner edge of the gearwheel 40.

There is further an engine 60 within the vessel 10 and a generator 62 connected with a third shaft 61 to the engine 60. The engine 60 can be a conventional combustion engine used in vessels 10. The generator 62 produces electric energy needed in the vessel 10 and the propulsion unit 20. There can be several combustion engines 60 and generators 62 in a vessel 10.

There is further a slip ring arrangement 70 in connection with the gearwheel 40. Electric power is transferred from the generator 62 to the slip ring arrangement 70 with a first cable 65. Electric power is further transferred from the slip ring arrangement 70 to the first electric motor 30 with a second cable 35. The slip ring arrangement 70 is needed in order to transfer electric power between the stationary hull 10 of the vessel and the rotating propulsion unit 20.

Figure 2:
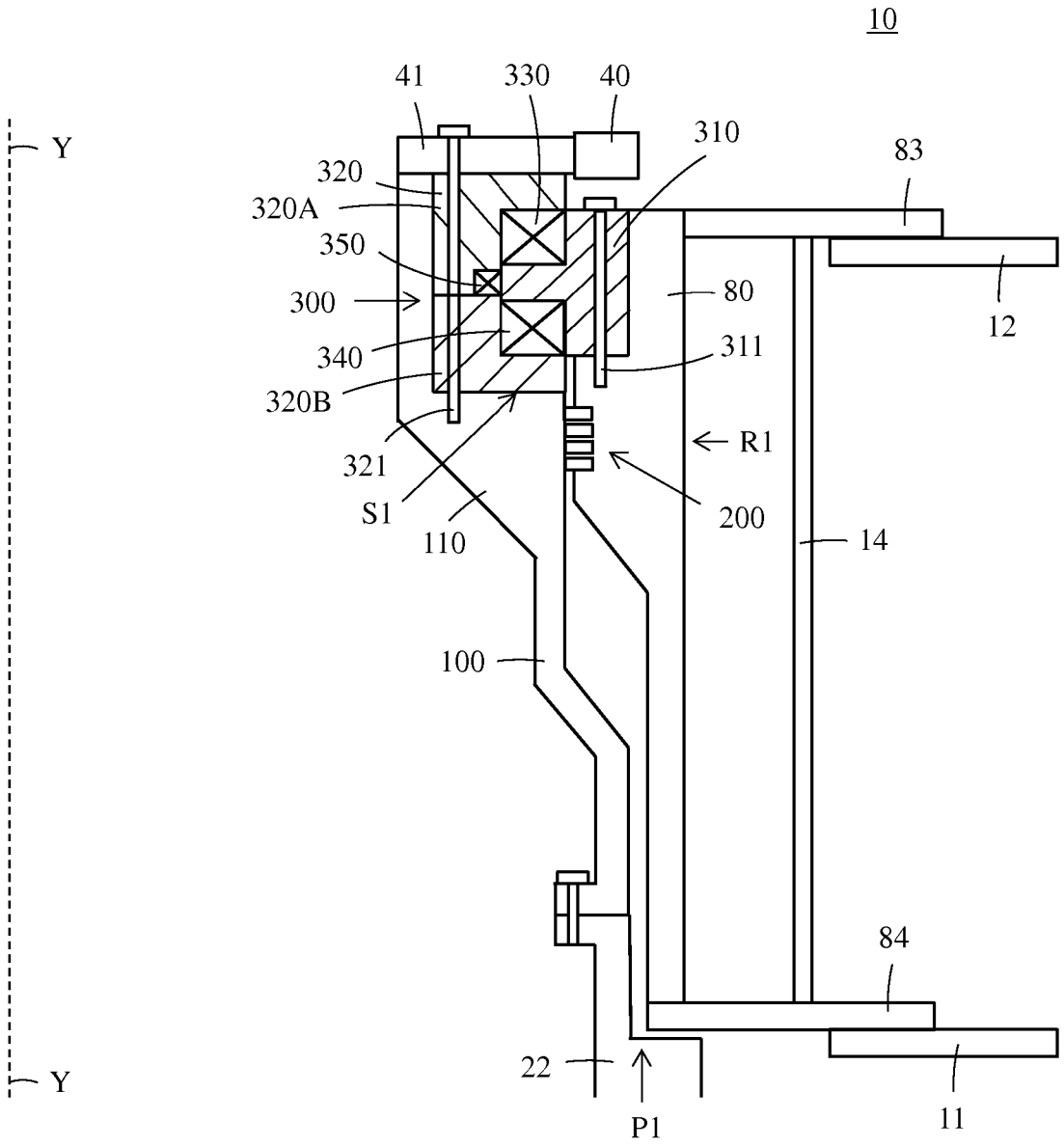
FIG. 2 (Prior art)
FIG. 2 shows a vertical cross section of a prior art slewing seal arrangement of the propulsion unit.

FIG. 2 shows a vertical cross section of a prior art slewing seal arrangement of a propulsion unit. The cross section shows only the right half of the arrangement, which is symmetrical in view of the centre axis Y-Y of rotation. The slewing bearing 300 comprises a first bearing block 310, a second bearing block 320, first roller means 330, second roller means 340 and third roller means 350.

The first bearing block 310 is a cylindrical part attached with vertically extending bolts 311 to a vertically extending stationary first support wall 80. The first support wall 80 has advantageously a generally cylindrical from. The upper end portion of the first support wall 80 is attached to a horizontally extending first support ring 83. The first support ring 83 is attached to the second inner bottom 12 of the vessel 10.

The lower end of the first support wall 80 is attached to a horizontally extending second support ring 84. The second support ring 84 is attached to the first outer bottom 11 of the vessel 10. The figure shows also a second support wall 14 extending vertically between the first support ring 83 and the second support ring 84. The cross section of the first bearing block 310 has essentially the form of a 90 degrees tilted letter T.

The second bearing block 320 is a cylindrical part comprising an upper part 320A and a lower part 320B. The second bearing block 320 is attached with vertically through the upper part 320A and the lower part 320B extending bolts 321 to a vertically extending cylindrical rotating second support part 110. The second support part 110 is formed by an upper portion of the upper block 100. The upper end 22 of the strut 21 of the propulsion unit 20 is attached to the lower end of the upper block 100. The cross section of the second bearing block 320 has essentially the form of a letter C.

The first roller means 330 is positioned in a raceway between the first bearing block 310 and the second bearing block 320 so that the downwards directed forces caused e.g. by the weight of the propulsion unit 20 are transferred from the second bearing block 320 through the first roller means 330 to the first bearing block 310 and further to the hull of the vessel 10.

The second roller means 340 is positioned in a raceway between the first bearing block 310 and the second bearing block 320 so that the upwards directed forces are transferred from the second bearing block 320 through the second roller means 340 to the first bearing block 310 and further to the hull of the vessel 10.

The third roller means 350 is positioned in a raceway between the first bearing block 310 and the second bearing block 320 so that the radial forces are transferred from the second bearing block 320 through the third roller means 350 to the first bearing block 310 and further to the hull of the vessel 10.

An inner portion 41 of the gearwheel 40 rests on the second bearing block 320 and is attached with vertically extending bolts 321 to a second support part 110 being part of the upper block 100. The vertically extending bolts 321 extend also through the second bearing block 320. The rotation of the gearwheel 40 rotates the upper block 100 and thereby also the propulsion unit 20 around the centre axis Y-Y of rotation.

The upper block 100 is positioned in the passage P1 formed by the first support wall 80 between the first outer bottom 11 and the second inner bottom 12 of the vessel 10. Said upper block 100 is in this embodiment a separate part, which is attached to the upper portion 22 of the strut 21.

Figure 3:
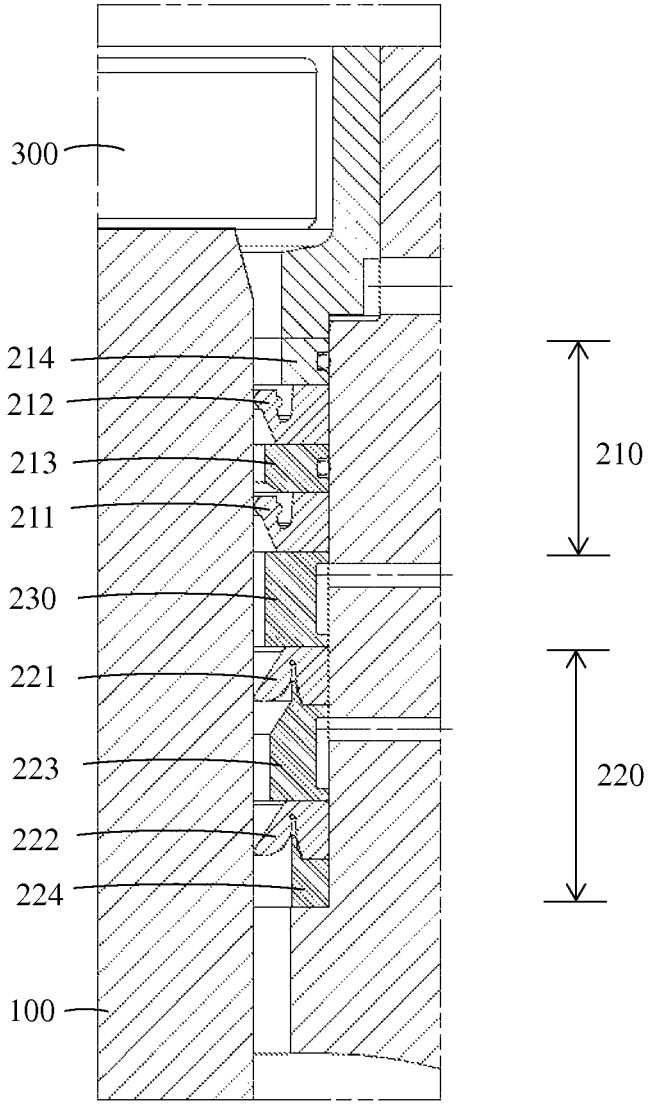
FIG. 3 (Prior art)
FIG. 3 shows a vertical cross section of an enlargement of the prior art slewing seal arrangement in FIG. 2.

FIG. 3 shows a vertical cross section of an enlargement of the prior art slewing seal arrangement in FIG. 2. The slewing seal 200 is positioned in a recess in the first support wall 80 below the slewing bearing 300. The slewing seal 200 comprises an upper slewing seal 210 having two seal rings 211, 212 and a lower slewing seal 220 having two seal rings 221, 222. The outer end lip portions of the slewing seal rings 211, 212, 221, 222 are pressed against the outer surface of the upper portion 110 of the rotating upper block 100. The upper slewing seal 210 prevents lubrication medium from the slewing bearing 300 to pass down between the rotating part 110 and the first support wall 80 and further to the sea. The lower slewing seal 220 prevents sea water from penetrating into the slewing bearing 300 and further into the hull of the vessel 10. There could naturally be any number of seal rings 211, 212, 221, 222 in the upper slewing seal 210 and the lower slewing seal 220.

There is further an intermediate ring 213 between the seal rings 211, 212 in the upper slewing seal 210 and an intermediate rings 223 between the sealing rings 221, 222 in the lower slewing seal 220. There is further an intermediate ring 230 between the upper slewing seal 210 and the lower slewing seal 220 and an end ring 214 above the upper slewing seal 210 and an end ring 224 below the lower slewing seal 220. There are further lubrication ducts leading to the intermediate ring 214 between the upper slewing seal 210 and the lower slewing seal 220 and between the seal rings 221, 222 in the lower slewing seal 210.

The upper slewing seal 210 and the lower slewing seal 220 are positioned in a recess formed in the first support wall 80. There is no open space between the upper slewing seal 210 and the lower slewing seal 220. There is also no access to the slewing seal 200 in the radial direction R1 from the interior of the vessel 10 from the space between the first outer bottom 11 and the second inner bottom 12 of the vessel 10. The outer surface of the cylindrical first support wall 80 forms a closed surface towards the space between the first outer bottom 11 and the second inner bottom 12 of the vessel 10.

One problem in such a prior art slewing seal arrangement is the position of the slewing seal 200. The gearwheel 40 and the slewing bearing 300 have to be disconnected and removed before there is access to the slewing seal 200. The slewing seal 200 can only be accessed from above. There is no possibility to access the slewing seal 200 radially from the side. The first support wall 80 forms a cylindrical closed space between the first support ring 83 and the second support ring 84.

Another problem in such a prior art support arrangement is the position of the slewing bearing 300. The slewing bearing 300 is positioned below the second inner bottom 12 of the ship 10. The slewing bearing 300 will on the one hand be subjected to cold air from the sea propagating along the steel structures and on the other hand to cooling air passing through the outer part of the interior of the cylindrical upper block 100 down to the first electric motor 30 in the propulsion unit 20. The air from the sea could be very cold when the vessel is operated in a cold climate. There could thus be an uneven temperature distribution throughout the slewing bearing 300 leading to thermal stresses in the slewing bearing 300.

Figure 4:
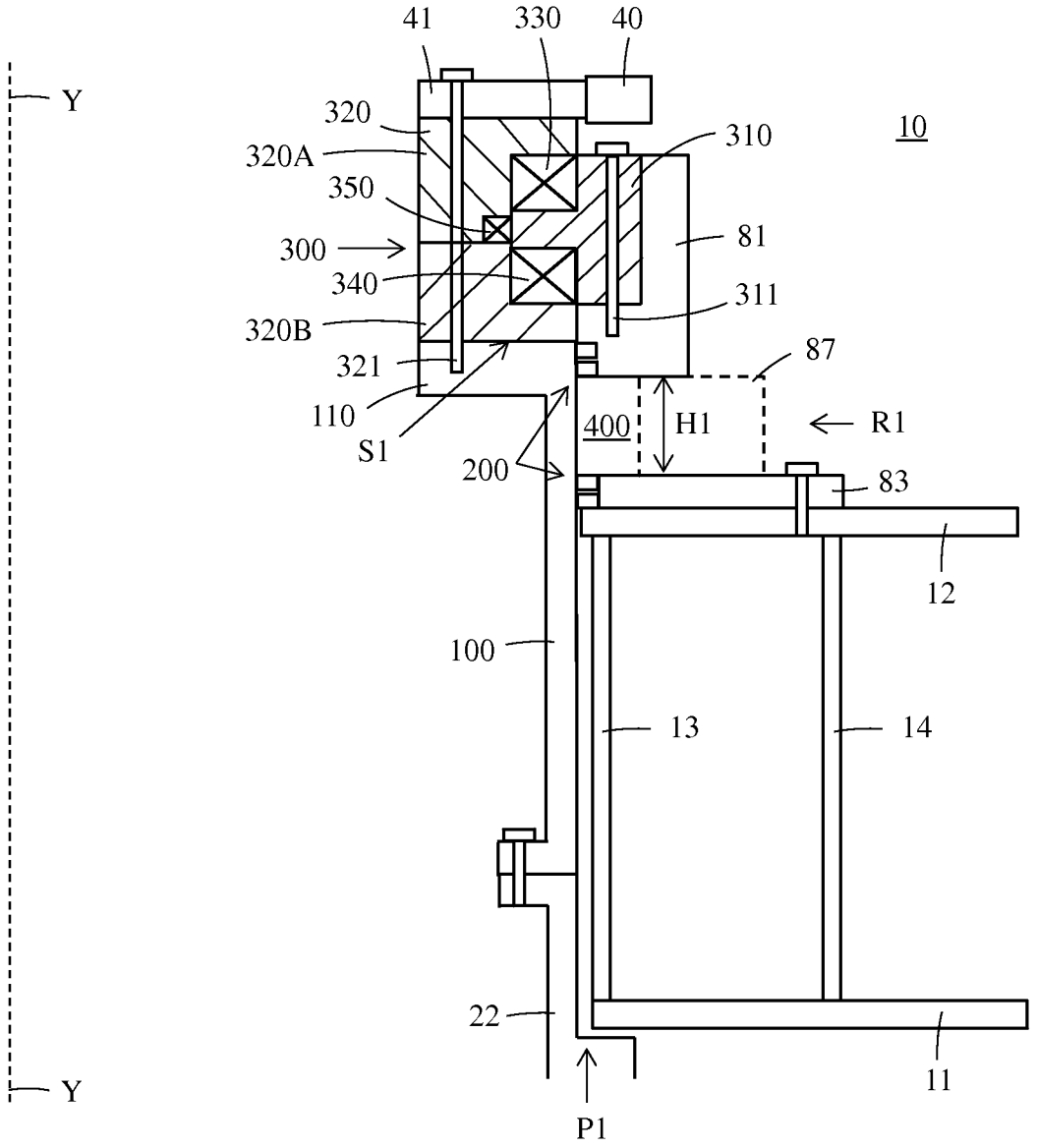
FIG. 4 shows a vertical cross section of a slewing seal arrangement according to a first embodiment of the invention.

FIG. 4 shows a vertical cross section of a slewing seal arrangement according to a first embodiment of the invention. The cross section shows only the right half of the arrangement, which is symmetrical in view of the centre axis Y-Y of rotation. The slewing bearing 300 and the slewing seal 200 are in this embodiment positioned above the second inner bottom 12 of the vessel 10. The lower surface S1 of the slewing bearing 300 is positioned above the second inner bottom 12 of the vessel 10. The slewing bearing 300 is thus surrounded by the air in the interior of the vessel 10. The air temperature in the interior of the vessel 10 is rather constant, which means that the slewing bearing 300 is subjected to less thermal stresses. The change of the slewing seal 200 is in this arrangement easy.

The first bearing block 310 is attached with vertically extending bolts 311 to a stationary cylindrical first support part 81. The first support part 81 is supported on the second inner bottom 12 of the vessel 10 e.g. with radially and vertically extending support flanges 87 positioned between the first support part 81 and the first support ring 83. The first support ring 83 is attached to the upper surface of the second inner bottom 12 of the vessel 10. The first support part 81 is thus supported only on the second inner bottom 12 of the vessel 10 through the support flanges 87. The first support part 81 is positioned entirely above the second inner bottom 12 of the vessel 10.

The second bearing block 320 is a cylindrical part comprising an upper part 320A and a lower part 320B. The second bearing block 320 is attached with vertically through the upper part 320A and the lower part 320B extending bolts 321 to a vertically extending cylindrical rotating second support part 110, which is formed of the upper portion of the upper block 100. The upper end 22 of the strut 21 of the propulsion unit 20 is attached to the lower end of the upper block 100.

A first support wall 13 extends vertically between the first outer bottom 11 and the second inner bottom 12 of the vessel 10. The first support wall 13 is advantageously circular and closes the space between the first outer bottom 11 and the second inner bottom 12 towards the passage P1 formed between the first outer bottom 11 and the second inner bottom 12 of the vessel 10. The figure also shows a vertically between the first outer bottom 11 and the second inner bottom 12 extending second support wall 14.

An inner portion 41 of the gearwheel 40 rests on the second bearing block 320. The inner portion 41 of the gearwheel 40 is attached with vertically extending bolts 321 to the second support part 110. The vertically extending bolts 321 extend also through the second bearing block 320. The rotation of the gearwheel 40 rotates the upper block 100 and the propulsion unit 20 around the centre axis Y-Y.

Figure 5:
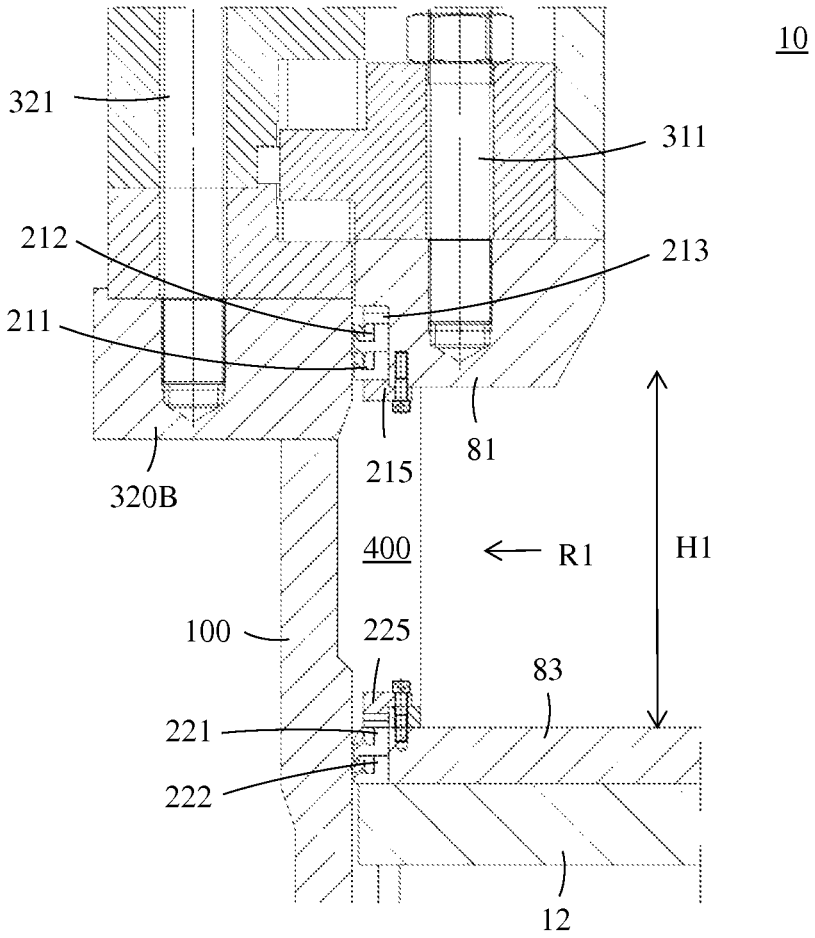
FIG. 5 shows a vertical cross section of an enlargement of the slewing seal arrangement in FIG. 4.

FIG. 5 shows an enlargement of the slewing seal arrangement in FIG. 4. The slewing seal 200 comprises an upper slewing seal 210 and a lower slewing seal 220.

The upper slewing seal 210 comprises two seal rings 211, 212 and an end ring 213. Each seal ring 211, 212 is composed of a base part and a lip part. The lip part forms the sealing against the rotating part 100. The upper slewing seal 210 is seated in a recess formed in the first support part 81. There is further a bracket 215 securing the upper slewing seal 210 into the recess. The bracket 215 can be attached e.g. with a bolt to the lower surface of the first support part 81. The upper slewing seal 210 can be changed by removing the bracket 215 and pulling the parts of the upper slewing seal 210 downwards out from the recess.

The lower slewing seal 220 comprises two seal rings 221, 222. Each seal ring 221, 222 is composed of a base part and a lip part. The lip part forms the sealing against the rotating part 100. The lower slewing seal 220 is seated in a recess formed in connection with the inner edge of the first support ring 83. There is further a bracket 225 securing the lower slewing seal 210 into the recess. The bracket 225 can be attached e.g. with a bolt to the upper surface of the first support ring 83. The lower slewing seal 220 can be changed by removing the bracket 225 and pulling the parts of the lower slewing seal 220 upwards out from the recess.

The upper slewing seal 210 and the lower slewing seal 220 may be provided with lubrication if needed. This can be arranged in any prior known way known by a person skilled in the art. Lubrication may be needed in order to prevent dry running, overheating and premature wear of the lip parts of the seal rings 211, 212, 221, 222.

This is just one embodiment of a slewing seal 200 construction that can be used in the invention. The upper slewing seal 210 and the lower slewing seal 220 may comprise any number of seal rings, any number of intermediate rings and any number of end rings, possible emergency seal rings etc. The position of the different parts within a slewing seal 210, 220 can be arbitrarily. Intermediate rings are not necessarily needed at all. The upper slewing seal 210 and the lower slewing seal 220 must naturally comprise at least one seal ring.

The seal rings 211, 212, 221, 222 in the upper slewing seal 210 and in the lower slewing seal 220 are of an elastic material e.g. rubber.

There is a space 400 between the upper slewing seal 210 and the lower slewing seal 220. The space 400 has a height H1 in the vertical direction. There is also access provided to this space 400 in a radial direction R1 from the interior of the hull of the vessel 10. The access is through the passages formed between the radially and vertically extending support flanges 87. It is possible to service the upper slewing seal 210 and the lower slewing seal 220 via this space 400.

Figure 6:
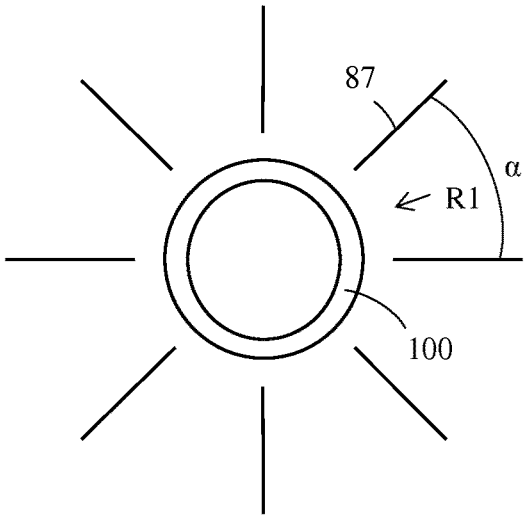
FIG. 6 shows a first horizontal cross section of the arrangement in FIG. 4.

FIG. 6 shows a first horizontal cross section of the arrangement in FIG. 4. The horizontal cross section is from a level between the upper slewing seal 210 and the lower slewing seal 220. The figure shows the radially and vertically extending support flanges 87 between the first support part 81 and the first support ring 83. The inner ends of the support flanges 87 are positioned at a radial distance from the rotating part 100. The support flanges 87 are positioned at an angular distance a from each other. There has to be enough space between two adjacent support flanges 87 so that the change of the upper slewing seal 210 and the lower slewing seal 220 can be done.

Figure 7:
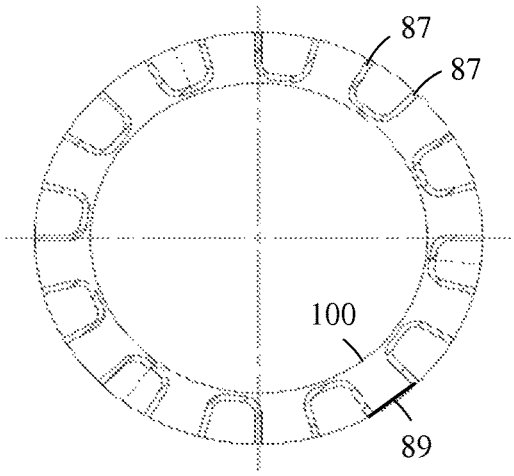
FIG. 7 shows a horizontal cross section of an alternative of FIG. 4.

FIG. 7 shows a horizontal cross section of an alternative of FIG. 4. This figure shows an alternative support arrangement between the slewing bearing 300 and the second inner bottom 12 of the vessel. The vertically and radially extending support flanges 87 are grouped into groups of two and the inner ends of each end are connected as shown in the figure. Access to the upper block 100 is still provided between two adjacent support flanges 87 that are not connected at their inner ends. Each group of two support flanges 87 have a U-shaped form as is seen from the figure. The figure shows also a hatch 89 between two adjacent support flanges 87. Hatches 89 can be used between all openings formed between two adjacent support flanges 87 in order to close said space. The hatches 89 provide on the other hand access to said space if needed. Such hatches can naturally also be used in all the embodiments of the invention if there is a need to close the space between the slewing seals 210, 220. Hatches could e.g. be positioned between the support flanges 87 shown in FIG. 6 in order to close the space between the slewing seals 210, 220.

Figure 8:
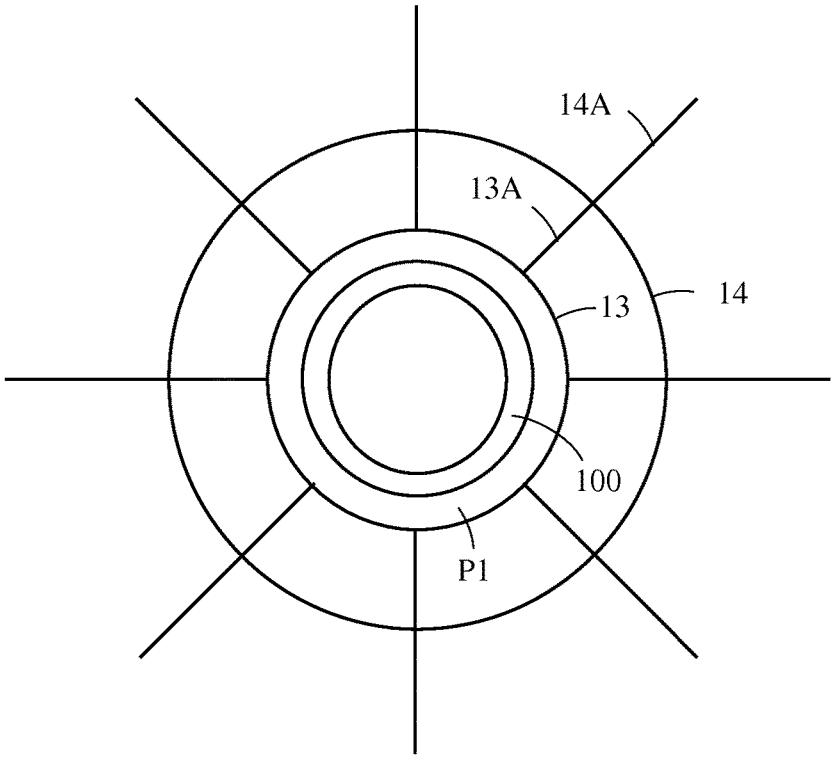
FIG. 8 shows a second horizontal cross section of the space in a vessel between the first outer bottom and the second inner bottom.

FIG. 8 shows a second horizontal cross section of the space between the first outer bottom 11 and the second inner bottom 12 in a vessel. The support construction between the first outer bottom 11 and the second inner bottom 12 comprises radially extending support walls 13A, 14A and circularly extending support walls 13, 14. The circularly extending support walls 13, 14 could instead of circular be straight between the radial support walls 13A, 14A. The figure shows also the rotating part 100 and the passage P1 between the rotating part 100 and the stationary part 13. The space between the first outer bottom 11 and the second inner bottom 12 comprises thus compartments formed within the radially extending support walls 13A, 14A and the circular support walls 13, 14. There can be openings between the compartments.

Figure 9:
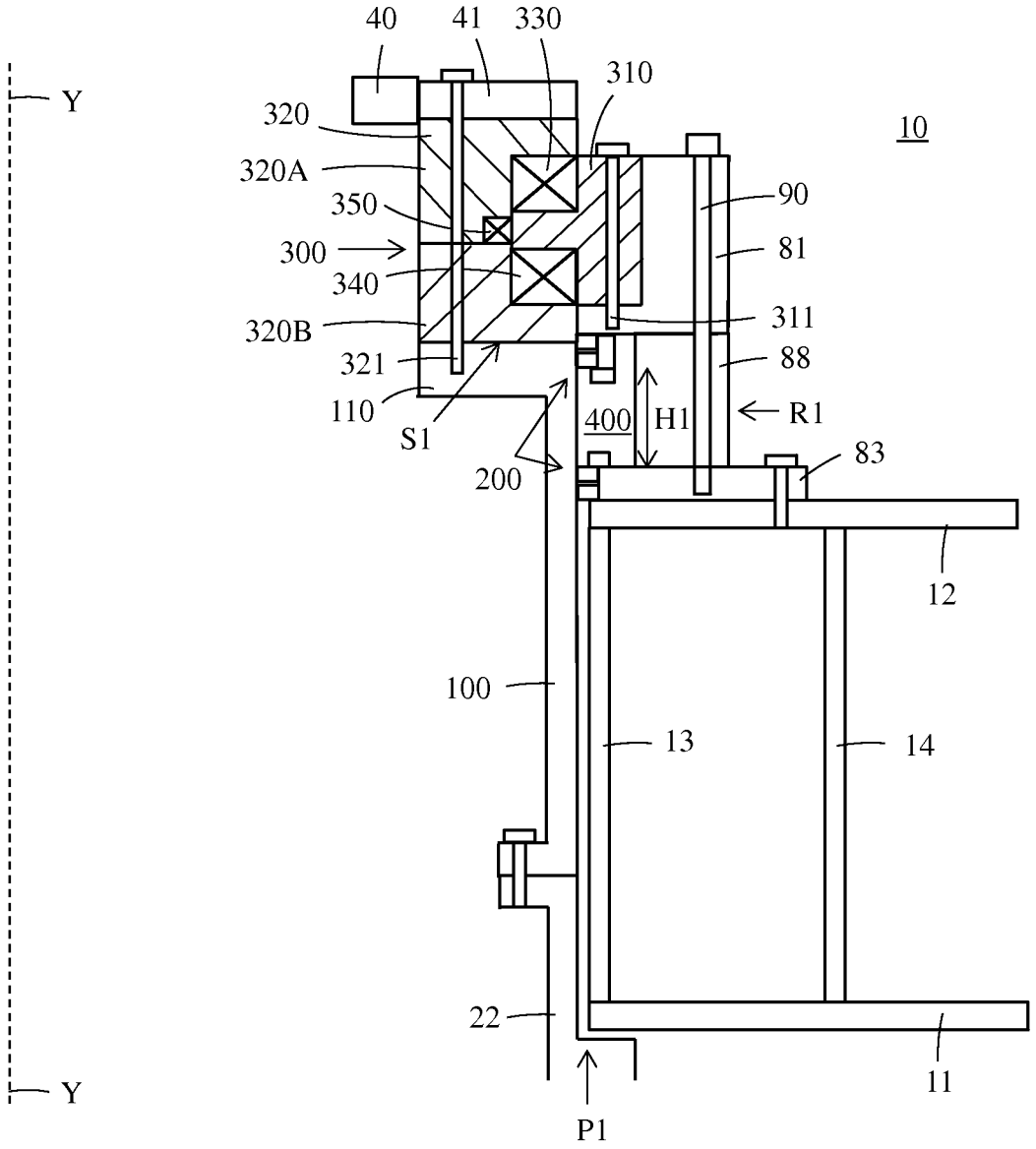
FIG. 9 shows a vertical cross section of a slewing seal arrangement according to a second embodiment of the invention.

FIG. 9 shows a vertical cross section of a slewing seal arrangement according to a second embodiment of the invention. The cross section shows only the right half of the arrangement, which is symmetrical in view of the vertical centre axis Y-Y. The slewing bearing 300 and the slewing seal 200 are in this third embodiment positioned above the second inner bottom 12 of the vessel 10 as in the first embodiment. The lower surface S1 of the slewing bearing 300 is positioned above the second inner bottom 12 of the vessel 10. The cogs of the gearwheel 40 are in this embodiment on the inner edge of the gearwheel 40.

The first bearing block 310 is attached with vertically extending bolts 311 on a cylindrical first support part 81. The first support part 81 could be supported on the second inner bottom 12 of the vessel 10 with radially and vertically extending support flanges 87 positioned between the first support part 81 and the first support ring 83 in the same way as in the first embodiment. The first support ring 83 is attached to the upper surface of the second inner bottom 12 of the vessel 10. The radially and vertically extending support flanges 87 could be positioned at a suitable angular distance from each other on the circumference between the first support part 81 and the first support ring 83 in order to provide access to the slewing seal 200 between two adjacent support walls.

Another possibility to support the first support part 81 on the second inner bottom 12 of the vessel 10 is to use removable support elements 88 between the first support part 81 and the first support ring 83. The first support ring 83 is attached to the upper surface of the second inner bottom 12 of the vessel 10. There can be any number e.g. four support elements 88 forming a circle. Fastening means e.g. bolts 90 extend in the vertical direction through the first support part 81 and the support elements 88. The fastening bolts 90 in one support element 88 can be disconnected and removed so that said support element 88 is ready to be removed from the position under the first support part 81. The removal of the support element 88 can be done by lifting the first support part 81 a little bit by a suitable lifting means e.g. a crane. The removal of the support element 88 can on the other hand be done by removing the bolts 90 from adjacent support elements 88 and using jack-up bolts instead of the bolts 90. The jack-up bolts are used to lift the first support part 81 a little bit so that the support elements 88 between the two adjacent support elements 88 can be removed.

The second bearing block 320 is a cylindrical part comprising an upper part 320A and a lower part 320B. The second bearing block 320 is attached with vertically through the upper part 320A and the lower part 320B extending bolts 321 to a vertically extending cylindrical rotating second support part 110, which is formed of the upper portion of the upper block 100. The upper end 22 of the strut 21 of the propulsion unit 20 is attached to the lower end of the upper block 100.

An inner portion 41 of the gearwheel 40 rests on the second bearing block 320. The inner portion 41 of the gearwheel 40 is attached with vertically extending bolts 321 to the second support part 110. The vertically extending blots 321 extend also through the second bearing block 320. The rotation of the gearwheel 40 rotates the upper block 100 and the propulsion unit 20 around the centre axis Y-Y.

The construction of the slewing seal 200 corresponds to the construction of the slewing seal in the first embodiment. The upper slewing seal 210 is positioned in a recess formed in first support part 81. The lower slewing seal 220 is positioned in a recess formed in connection with the inner edge of the first support ring 83.

There is a space 400 between the upper slewing seal 210 and the lower slewing seal 220. The space 400 has a height H1 in the vertical direction. There is also access provided to this space 400 in a radial direction R1 from the interior of the hull of the vessel 10. The access is through the passages formed between the support elements 88. It is possible to service the upper slewing seal 210 and the lower slewing seal 220 via this space 400.

This second embodiment shown in FIG. 9 could be changed so that the support elements 88 are changed to bushings extending between the bearing 300 and the second inner bottom 12 of the vessel 10. The bushings could advantageously have a cylindrical form. A bushing would be provided in connection with each fastening means 90 so that the fastening means i.e. the bolt 90 would pass through a hole in the middle of the bushing. The service of the slewing seals 210, 220 could be done from the spaces between the bushings.

Figure 10:
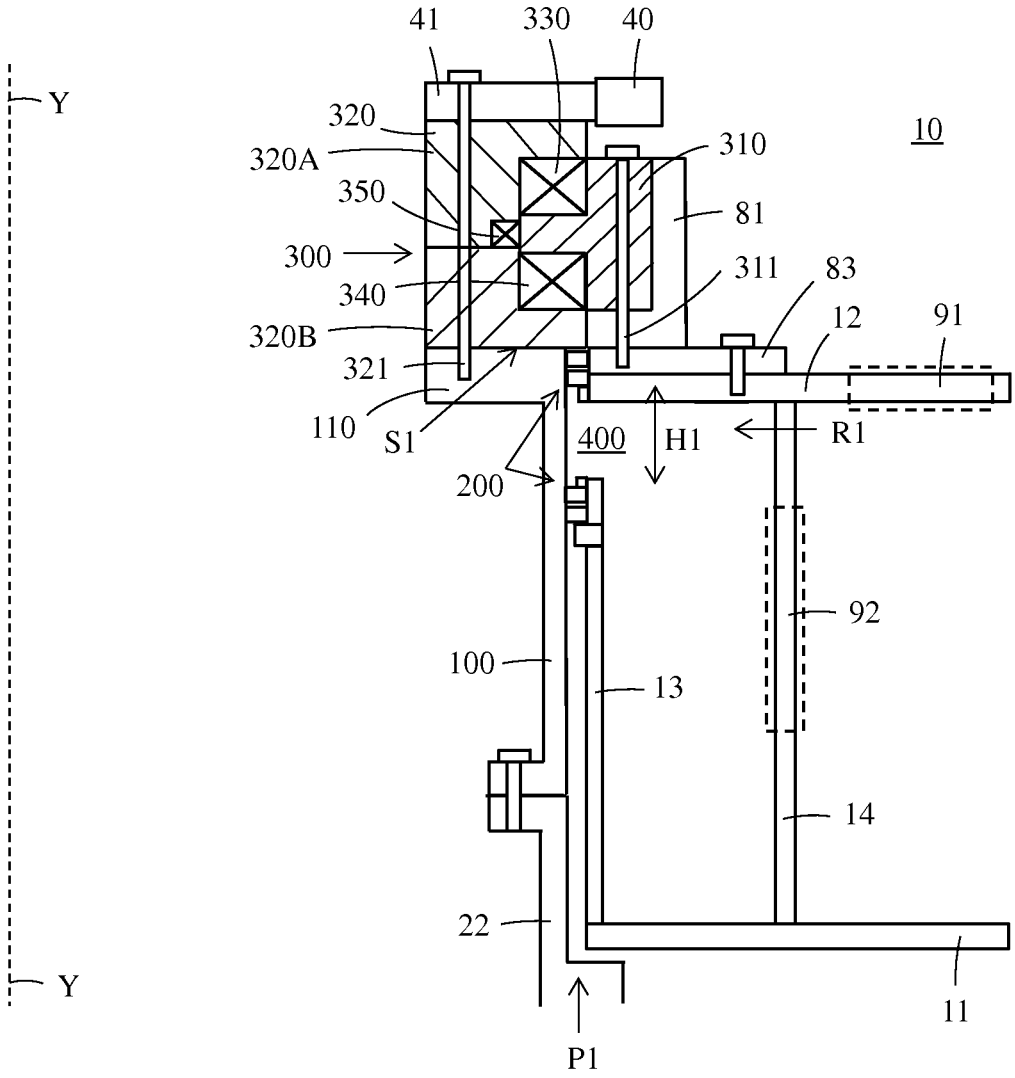
FIG. 10 shows a vertical cross section of a slewing seal arrangement according to a third embodiment of the invention.

FIG. 10 shows a vertical cross section of a slewing seal arrangement according to a third embodiment of the invention. The cross section shows only the right half of the arrangement, which is symmetrical in view of the vertical centre axis Y-Y. The slewing bearing 300 is in this embodiment still positioned above the second inner bottom 12 of the vessel 10. The lower surface S1 of the slewing bearing 300 is positioned on the level of the first support ring 83, which is attached to the second inner surface 12 of the vessel 10. The slewing seal 200 is positioned below the second inner bottom 12 of the vessel 10 in the space between the second inner bottom 12 and the first outer bottom 11 of the vessel 10.

The first bearing block 310 is attached with vertically extending bolts 311 on a first cylindrical support part 81, which is directly supported on the second inner bottom 12 of the vessel 10 via the first support ring 83. The vertically extending bolts 311 extend through the first support part 81 to the first support ring 83. The first support ring 83 is attached to the upper surface of the second inner bottom 12 of the vessel 10.

The second bearing block 320 is a cylindrical part comprising an upper part 320A and a lower part 320B. The second bearing block 320 is attached with vertically through the upper part 320A and the lower part 320B extending bolts 321 to a vertically extending cylindrical rotating second support part 110, which is formed of the upper portion of the upper block 100. The upper end 22 of the strut 21 of the propulsion unit 20 is attached to the lower end of the upper block 100.

An inner portion 41 of the gearwheel 40 rests on the second bearing block 320. The inner portion 41 of the gearwheel 40 is attached with vertically extending bolts 321 to the second support part 110. The vertically extending bolts 321 extend also through the second bearing block 320. The rotation of the gearwheel 40 rotates the upper block 100 and the propulsion unit 20 around the centre axis Y-Y.

The construction of the slewing seal 200 can correspond to the construction of the slewing seal shown in FIG. 5. The upper slewing seal 210 is positioned in a recess formed in connection with the inner edge of the second inner bottom 12 and the inner edge of the first support ring 83. The lower slewing seal 220 is positioned in a recess formed in connection with the upper end of the first support wall 13. The upper slewing seal 210 and the lower slewing seal 220 comprises both two seal rings. The first support wall 13 is attached to the first outer bottom 11 and closes the space between the first outer bottom 11 and the lower slewing seal 220 towards the passage P1. There is a space 400 between the upper slewing seal 210 and the lower slewing seal 220. The space 400 has a height H1 in the vertical direction. The slewing seal 200 can in this third embodiment be changed from the space between the second inner bottom 12 and the first outer bottom 11 of the vessel 10 in the same way as described in connection with the first embodiment.

Access to the position of the slewing seal 200 below the second inner bottom 12 is provided via one or more maintenance hatches 91 through the second inner bottom 12 to the space between the first outer bottom 11 and the second inner bottom 12 of the vessel 10. Further maintenance hatches 92 are provided in the vertically extending second support walls 14. Further maintenance hatches are provided in the radially extending support walls 13A between the innermost compartments formed between the first support wall 13 and the second support wall 14 in the circumferential direction. All these maintenance hatches are normally provided in a vessel. Access to the slewing seal 200 should be provided along essentially the whole circumference of the slewing seal 200 at suitable intervals so that the slewing seal 200 can be serviced. The cylindrical first support wall 13 could extend between the first outer bottom 11 and the first inner bottom 12. The first support wall 13 would then have to be provided with suitable openings around the circumference of the first support wall 13 between the upper slewing seal 210 and the lower slewing seal 220. The openings in the first support wall 13 would then provide radial access from the space between the first outer bottom 11 and the second inner bottom 12 to the upper slewing seal 210 and the lower slewing seal 220. The lower slewing seal 220 could be supported on the first support wall 13 at the lower edge of the openings.

The first support wall 13 extends vertically between the first outer bottom 11 and the lower slewing seal 220. The first support wall 13 closes the space between the first outer bottom 11 and the lower slewing seal 220 towards the passage P1 formed between the first outer bottom 11 and the lower slewing seal 220.

Figure 11:
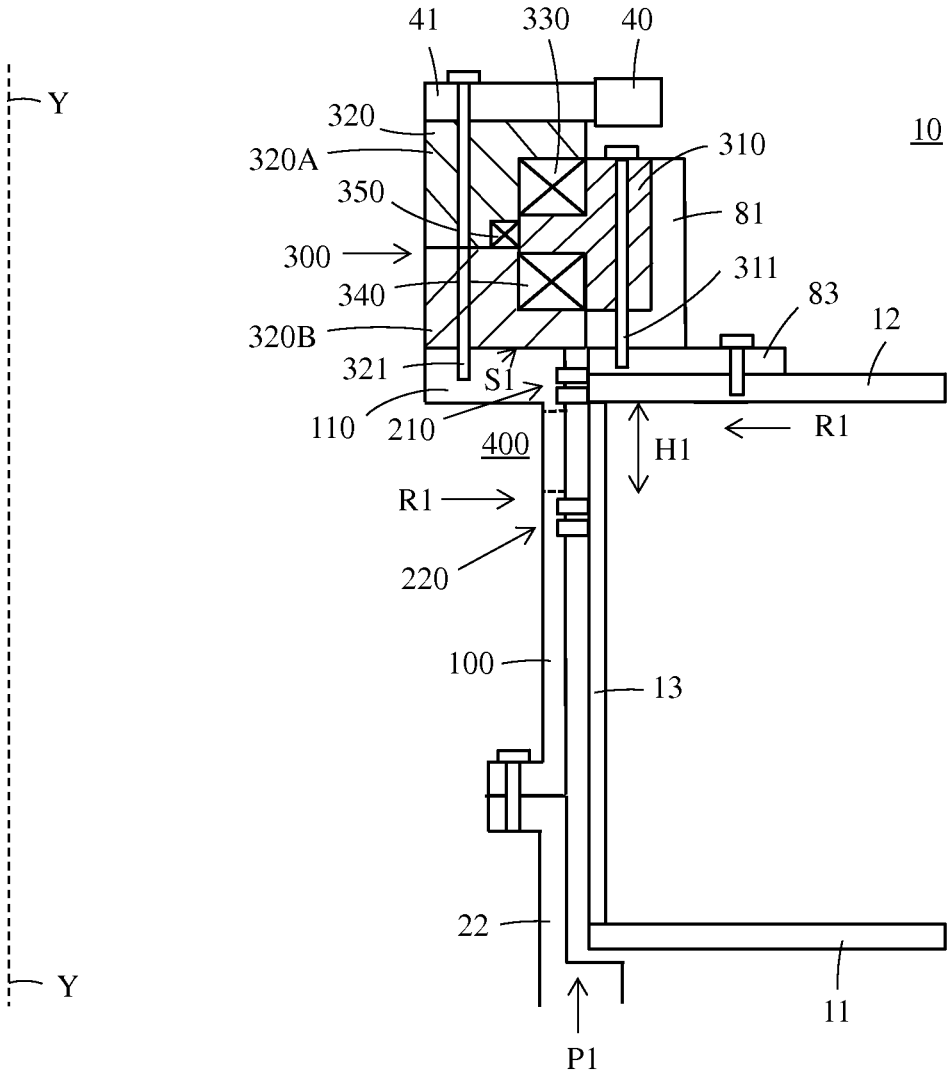
FIG. 11 shows a vertical cross section of a slewing seal arrangement according to a fourth embodiment of the invention.

FIG. 11 shows a vertical cross section of a slewing seal arrangement according to a fourth embodiment of the invention. The cross section shows only the right half of the arrangement, which is symmetrical in view of the vertical centre axis Y-Y. The slewing bearing 300 is in this embodiment still positioned above the second inner bottom 12 of the vessel 10. The lower surface S1 of the slewing bearing 300 is positioned on the level of the first support ring 83, which is attached to the second inner surface 12 of the vessel 10.

The bearing 300 corresponds to the bearing in FIG. 10. Reference is therefore made to FIG. 10 relating to the construction of the bearing 300.

An inner portion 41 of the gearwheel 40 rests on the second bearing block 320. The inner portion 41 of the gearwheel 40 is attached with vertically extending bolts 321 to the second support part 110. The vertically extending bolts 321 extend also through the second bearing block 320. The rotation of the gearwheel 40 rotates the upper block 100 and the propulsion unit 20 around the centre axis Y-Y.

The upper slewing seal 210 is positioned immediately below the slewing bearing 300 in order to prevent leakage of lubrication medium from the slewing bearing 300. The upper slewing seal 210 can be supported on the first support wall 13 in which case the upper slewing seal 210 can be changed from the space between the first outer bottom 11 and the second inner bottom 12 of the vessel 10. The upper slewing seal 210 can on the other hand be supported on the upper block 100 in which case the upper slewing seal 210 can be changed from the interior of the upper block 100 i.e. from the interior of the strut 21.

The lower slewing seal 220 is supported on the upper block 100 which means that the lower slewing seal 220 can be changed from the interior of the upper block 100 i.e. from the interior of the strut 21.

There is a space 400 between the upper slewing seal 210 and the lower slewing seal 220. The space 400 has a vertical distance H1. Access to the upper slewing seal 210 is provided in the radial direction R1 from the space between the first outer bottom 11 and the second inner bottom 12 of the vessel 10 or in the radial direction R1 from the space within the upper block 100. Access to the lower slewing seal 220 is provided in the radial direction R1 from the space within the upper block 100.

The embodiment shown in FIG. 4 and the embodiment shown in FIG. 9 have in common that the slewing bearing 300 is supported on the second inner bottom 12 of the vessel 10 by a support structure 87, 88 extending between the slewing bearing 300 and the second inner bottom 12, whereby the slewing seal 200 is accessible from spaces arranged in the support structure 87, 88.

There are two seal rings in the upper slewing seal 210 and the lower slewing seal 220 in the different embodiments of the inventive arrangement shown in the figures. There could naturally be any number of seal rings in the upper slewing seal 210 and the lower slewing seal 220. There must naturally be at least one seal ring in the upper slewing seal 210 and one seal ring in the lower slewing seal 220.

The upper slewing seal 210 and the lower slewing seal 220 are advantageously located at the same radial distance from the centre axis Y-Y of rotation. The upper slewing seal 210 and the lower slewing seal 220 could, however, also be located at a different radial distance from the centre axis Y-Y of rotation.

There is a space 400 between the upper slewing seal 210 and the lower slewing seal 220 in the different embodiments of the invention. The height H1 of the space 400 is at least 100 mm, advantageously at least 200 mm, more advantageously at least 300 mm. The height H1 is measured between the lower surface of the lowermost seal ring 211 in the upper slewing seal 210 and the upper surface of the uppermost seal ring 221 in the lower slewing seal 220. There is also access provided to this space 400 in a radial direction R1 from the interior of the hull of the vessel 10. The access can be provided from the space within the vessel above the second inner bottom 12 of the vessel and/or from the space between the first outer bottom 11 and the second inner bottom 12 and/or from the space within the strut 21.

The space 400 between the upper slewing seal 210 and the lower slewing seal 220 is advantageously an open space. The equipment for monitoring the condition of the slewing seal could be in the space, but they would be easily demountable when the upper slewing seal 210 and the lower slewing seal 220 is to be changed.

The invention is not limited to the slewing bearing 300 shown in the figures. Any standard roller or gliding bearing being lubricated with a lubrication medium could be used here. The lubrication medium could be e.g. oil or grease. The slewing bearing must not be in contact with sea water.

The arrangement in the figures shows a separate upper block 100 attached to the upper end portion of the upper portion 22 of the strut 21 of the propulsion unit 20. The upper block 100 could, however, be formed as an integral portion of the upper portion 22 of the strut 21. The upper block 100 would thus form an upper end portion of the upper portion 22 of the strut 21.

The arrangement is not limited to the propulsion unit shown in the figures. The arrangement can naturally be used also in connection with e.g. a mechanical drive unit. The motor could thus be positioned in the interior of the vessel, whereby the propeller would be connected to the motor by a horizontal and a vertical shaft. A slip ring unit would not be needed in such a case.

The strut 21 could naturally be turned by one or more hydraulic motors instead of one or more electric motors. The turning angle of the strut 21 could naturally be less than 360 degrees.

The invention and its embodiments are not limited to the examples described above but may vary within the scope of the claims.

The invention claimed is:

1. Slewing seal arrangement for a propulsion unit comprising a hollow strut having an upper portion and a lower portion, an upper end portion of the upper portion passing through a passage formed between a first outer bottom and a second inner bottom in a vessel, said upper end portion being rotatable, around an axis of rotation, supported at a hull of the vessel with a slewing bearing and sealed against the hull of the vessel with a slewing seal comprising an upper slewing seal and a lower slewing seal, wherein:

the upper slewing seal is positioned below the slewing bearing in order to prevent lubrication medium leakage from the slewing bearing, whereby access to the upper slewing seal is provided in a radial direction from the interior of the vessel or from the interior of the strut in order to be able to service the upper slewing seal, the lower slewing seal is positioned at a vertical distance below the upper slewing seal in order to prevent sea water from penetrating via the passage into the hull of the vessel, whereby access to the lower slewing seal is provided in a radial direction from the interior of the vessel or from the interior of the strut in order to be able to service the lower slewing seal.

2. Arrangement according to claim 1, wherein there is a space between the upper slewing seal and the lower slewing seal, whereby access is provided in a radial direction from the interior of the vessel to the space in order to be able to service the upper slewing seal and the lower slewing seal via said space.

3. Arrangement according to claim 1, wherein the upper slewing seal and the lower slewing seal are both positioned at or above the second inner bottom of the vessel.

4. Arrangement according to claim 1, wherein the slewing bearing is supported at the second inner bottom of the vessel by a support structure extending between the slewing bearing and the second inner bottom, whereby the upper slewing seal and the lower slewing seal are both accessible from spaces arranged in the support structure.

5. Arrangement according to claim 4, wherein the support structure comprises radially and vertically extending support flanges extending between the slewing bearing and the second inner bottom of the vessel, whereby the slewing seal is accessible from the spaces between adjacent radially and vertically extending support flanges.

6. Arrangement according to claim 5, wherein maintenance hatches are provided at the outer circumference of the radially extending support flanges between two consecutive support flanges, said maintenance hatches extending between the slewing bearing and the second inner bottom of the vessel.

7. Arrangement according to claim 4, wherein the support structure comprises circularly extending support elements extending between the slewing bearing and the second inner bottom of the vessel, whereby the slewing seal is accessible by removing a support element.

8. Arrangement according to claim 1, wherein the upper slewing seal and the lower slewing seal are positioned under the second inner bottom of the vessel in the space between the first outer bottom and the second inner bottom of the vessel, whereby the upper slewing seal and the lower slewing seal can be serviced from said space between the first outer bottom and the second inner bottom of the vessel.

9. Arrangement according to claim 1, wherein the upper slewing seal is positioned under the second inner bottom of the vessel in the space between the first outer bottom and the second inner bottom of the vessel, whereby the upper slewing seal can be serviced from said space between the first outer bottom and the second inner bottom, and the second slewing seal is positioned in a labyrinth construction being attached to or forming a part of the first outer bottom of the vessel, said labyrinth construction extending into the upper end portion of the upper portion of the strut and opening into the upper end portion, whereby the lower slewing seal can be serviced from the strut.

10. Arrangement according to claim 1, wherein the slewing bearing is positioned at or above the second inner bottom of the vessel so that the lower surface of the slewing bearing is at or above the second inner bottom of the vessel.

11. Arrangement according to claim 10, wherein the slewing bearing is supported directly on the second inner bottom of the vessel.

12. Arrangement according to claim 1, wherein the slewing bearing comprises a first bearing block being supported directly or indirectly on the second inner bottom of the vessel and a second bearing block being supported on the upper block or vice a versa, and roller or gliding means between the first bearing block and the second bearing block so that the first bearing block and the second bearing block are rotatable in relation to each other.

13. Arrangement according to claim 1, wherein the vertical distance is at least 100 mm.

14. Arrangement according to claim 1, wherein the vertical distance is at least 200 mm.

15. Arrangement according to claim 1, wherein the vertical distance is at least 300 mm.

16. Arrangement according to claim 2, wherein the upper slewing seal and the lower slewing seal are both positioned at or above the second inner bottom of the vessel.

17. Arrangement according to claim 2, wherein the slewing bearing is supported at the second inner bottom of the vessel by a support structure extending between the slewing bearing and the second inner bottom, whereby the upper slewing seal and the lower slewing seal are both accessible from spaces arranged in the support structure.

18. Arrangement according to claim 3, wherein the slewing bearing is supported at the second inner bottom of the vessel by a support structure extending between the slewing bearing and the second inner bottom, whereby the upper slewing seal and the lower slewing seal are both accessible from spaces arranged in the support structure.

19. Arrangement according to claim 16, wherein the slewing bearing is supported at the second inner bottom of the vessel by a support structure extending between the slewing bearing and the second inner bottom, whereby the upper slewing seal and the lower slewing seal are both accessible from spaces arranged in the support structure.

20. Arrangement according to claim 2, wherein the slewing bearing comprises a first bearing block being supported directly or indirectly on the second inner bottom of the vessel and a second bearing block being supported on the upper block or vice a versa, and roller or gliding means between the first bearing block and the second bearing block so that the first bearing block and the second bearing block are rotatable in relation to each other.

* * * * *